US006666245B2

(12) United States Patent
LaBahn et al.

(10) Patent No.: US 6,666,245 B2
(45) Date of Patent: Dec. 23, 2003

(54) TREE TRIMMING APPARATUS

(75) Inventors: Richard C. LaBahn, Orange, CA (US); Douglas W. LaBahn, Newport Beach, CA (US)

(73) Assignee: LeisureMore Corporation, Newport Beach, CA (US)

( * ) Notice: Subject to any disclaimer, the term of this patent is extended or adjusted under 35 U.S.C. 154(b) by 225 days.

(21) Appl. No.: 10/044,254

(22) Filed: Nov. 21, 2001

(65) Prior Publication Data

US 2003/0094086 A1 May 22, 2003

(51) Int. Cl.[7] ..... B27G 5/00; B27M 1/02; B27M 1/08; B25H 5/00

(52) U.S. Cl. ..... 144/367; 144/3.1; 144/35.1; 144/286.5; 144/365; 144/329; 29/26 R; 83/397; 83/574; 269/158; 269/254 CS; 408/27; 408/29

(58) Field of Search ..... 83/397, 468.1, 83/468.2, 468.7, 490, 574; 144/1.1, 2.1, 3.1, 34.1, 35.1, 286.1, 286.5, 365, 367, 379, 329; 29/26 R, 26 A, 243.56; 269/158, 254 CS; 408/22, 26, 27, 29

(56) References Cited

U.S. PATENT DOCUMENTS 4,874,156 A * 10/1989 Goldzweig ..... 269/158
5,953,975 A * 9/1999 Kreitzberg ..... 144/286.5

* cited by examiner

*Primary Examiner*—W. Donald Bray
(74) *Attorney, Agent, or Firm*—Drummond & Duckworth

(57) ABSTRACT

A tree trimming apparatus is provided for preparing a tree, such as a Christmas tree, for attachment to a tree stand. The tree trimming apparatus includes a raised platform supported by a plurality of legs. The platform also includes an opening for receiving the trunk of a tree. Below the platform is positioned a jaws assembly for affixing the tree in place. Meanwhile, the tree trimming apparatus includes a saw assembly for severing the base of the tree, and a drill assembly for drilling a recess into the bottom of the tree for receipt of the spike of a tree stand.

13 Claims, 9 Drawing Sheets

TREE TRIMMING APPARATUS

BACKGROUND OF THE INVENTION

The present invention relates to tree trimming apparatus. More particularly, the present invention relates to apparatus for placing trees into better condition for placement within tree stands.

Every year, millions of evergreen trees are cut down during winter holidays and used as decorations, referred to as "Christmas trees". The trees are typically sold at a "tree lot" where customers scan rows upon rows of trees before ultimately selecting one which best matches their desires.

Once chosen, the trees are usually placed on their sides and the bottom of the tree's trunk is leveled with a saw, such as a chainsaw. Then, a tree stand is attached to the tree's bottom. Tree stands vary greatly and may include nailing a set of wooden struts to the tree's bottom. Alternatively, prefabricated stands have been provided which use screws or jaws which are driven against the side of the tree's trunk. The tree stand may include a bowl for holding a supply of water and nutrients to preserve the tree for a longer period of time.

Unfortunately, the prior method for preparing the base of a tree for attachment to a tree stand suffers from numerous drawbacks. Foremost, the operation of a standard chainsaw is extremely dangerous. Every year, numerous persons are injured due to negligence in operating the saw or from unexpected backlash caused by the chainsaw blade striking the tree's trunk. Not only have numerous injuries occurred from chainsaw dangers, but the purveyors of Christmas tree lots must typically pay a large insurance premium to insure against these dangers. These insurance costs are then passed on to the general consumer in the form of higher prices for Christmas trees.

The traditional use of a chainsaw to prepare the base of a Christmas tree also suffers from an additional drawback. Since the tree is typically placed on its side, it is very difficult to visually determine the plane perpendicular to the tree's vertical axis. Therefore, persons trimming the base of the tree often trim the base at an angle significantly skewed from the cut originally sought. It is very difficult to maintain such a tree in a vertical orientation.

Some Christmas tree lots utilize a stand having a large spike which is driven into the center of the tree's bottom. To this end, the tree trunk's bottom is prepared by utilizing an electric drill to bore a recess into the center of the tree's base which acts as a guide for the tree stand's spike. Accordingly, trees prepared in this fashion first require a chainsaw to level the bottom of the tree and then a second tool, namely an electrical drill, to properly prepare the Christmas tree for attachment to a tree stand.

It would be advantageous to provide a tree trimming apparatus which properly prepared the base of a tree for a attachment to a tree stand. Moreover, it would be advantageous if the apparatus were safe to use and easily operated. It would also be advantageous to provide an apparatus which would prepare the base of a tree in a manner to provide proper vertical orientation of the tree after being placed in a tree stand.

SUMMARY OF THE INVENTION

The present invention addresses the aforementioned disadvantages by providing an improved tree trimming apparatus for preparing the base of a tree for attachment to a tree stand. The tree trimming assembly includes a raised platform supported by a frame having a plurality of legs. The platform is positioned in the horizontal plane and includes a circular opening sized for receipt of the trunk of a tree. Within the frame of the tree trimming apparatus are a jaws assembly, a saw assembly and a drill assembly.

The jaws assembly includes a plurality of jaws positioned underneath the platform which move radially inward and outward with respect to the center of the opening. In a preferred embodiment, the jaws assembly includes four jaws which are biased inwardly by springs. In operation, when a tree's trunk is projected downwardly through the platform's opening, the jaws are biased inwardly to grasp the tree's trunk and maintain the tree in a substantially vertical position. Preferably, the inward and outward movement of the jaws are controlled by a cable threaded through a plurality of pulleys so that retraction of the cable causes outward movement of the individual jaws. Retraction of the cable can be accomplished by various means such as by winding with a powered motor or hand crank, or by depression of a foot pedal.

The saw assembly of the tree trimming apparatus is also positioned under the platform within the frame. The saw assembly includes a motorized saw which is electrical or gas powered and has a saw blade. The motorized saw is rotatably attached to a vertical column so that the blade sweeps a path in the horizontal plane directly below the platform's opening. In operation, a tree trunk is projected downwardly through the platform's opening so that the bottom of the tree's trunk is positioned below the motorized saw's blade. Manual rotation of the motorized saw about the vertical column causes the blade to engage and pass through the tree's trunk leaving an even horizontal cut. Prior to trimming the base of the tree's trunk, the tree's trunk is aligned as close as possible to vertical and the jaws are forced inwardly to grasp the tree's trunk, so as to steady the tree during the motorized saw's cut.

Preferably, the motorized saw is vertically adjustable upon the vertical column so as to provide cuts of different thickness. Moreover, it is preferred that the saw assembly include a coil spring for rotating the motorized saw upon the vertical column to a first position prior to cutting. The coil spring also assures that the motorized saw will not obstruct the entry of the tree's trunk through the platform opening by rotating the motorized saw to a position where the opening is unobstructed. Also preferably, the saw assembly includes stops to restrict the path of the motorized saw blade to under the platform.

In a preferred embodiment of the invention, the tree trimming apparatus includes a drill assembly. The drill assembly includes a drill motor holding a drill bit. The drill motor and drill bit are positioned underneath the platform's opening with the drill bit vertically and centrally aligned with the center of the opening. The drill motor and drill bit are vertically movable so that the drill bit can be controllably moved upward or downward relative to the platform's opening.

In operation, once a tree trunk has been projected through the platform's opening, the drill bit is controllably moved upward so as to bore a recess into the bottom-center of the tree's trunk. The bored recess is then used to receive and guide the spike found on many tree stands, for assisting the engagement of a tree to a tree stand.

Preferably, movement of the drill assembly is controlled by the combination of a foot pedal and lever arm. Downward force, such as by a person's foot, upon the pedal causes the arm in fulcrum manner to force the drill assembly and drill bit upward to engage the bottom of a tree. Conversely, gravity causes the drill and drill bit to lower as force is removed from the foot pedal.

In still an additional preferred embodiment of the invention, the tree trimming apparatus includes a device for providing proper vertical alignment of the tree when the tree trunk is being trimmed and bored. To this end, the tree trimming apparatus includes a vertical pole projecting upwardly from the side of the frame. The pole is intended to extend upwardly beyond the height of trees placed within the platform's opening. Preferably, projecting horizontally from the top of the pole is a cross beam which is positioned and constructed so that an extremity of the crossbeam is positioned directly above the center of the platform's opening. Affixed to the crossbeam's extremity is a plumb line and plumb bob which extend downwardly by gravity. To vertically align the tree, the vertical alignment of the tree is compared and aligned to the vertical alignment of the pole, plumb bob and plumb line Advantageously, the tree trimming apparatus provides for a platform for safely and quickly trimming the base of a tree for attachment to a tree stand. The apparatus also provides for a clean horizontal cut which provides for proper vertical alignment of the tree when placed in the tree stand. Also advantageously, the tree trimming apparatus enables persons to bore a guide recess into the bottom of a tree for attaching the trunk of a tree to a tree stand.

Other features and advantages of the present invention will be appreciated by those skilled in the art upon reading the detailed description which follows with reference to the attached drawings.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
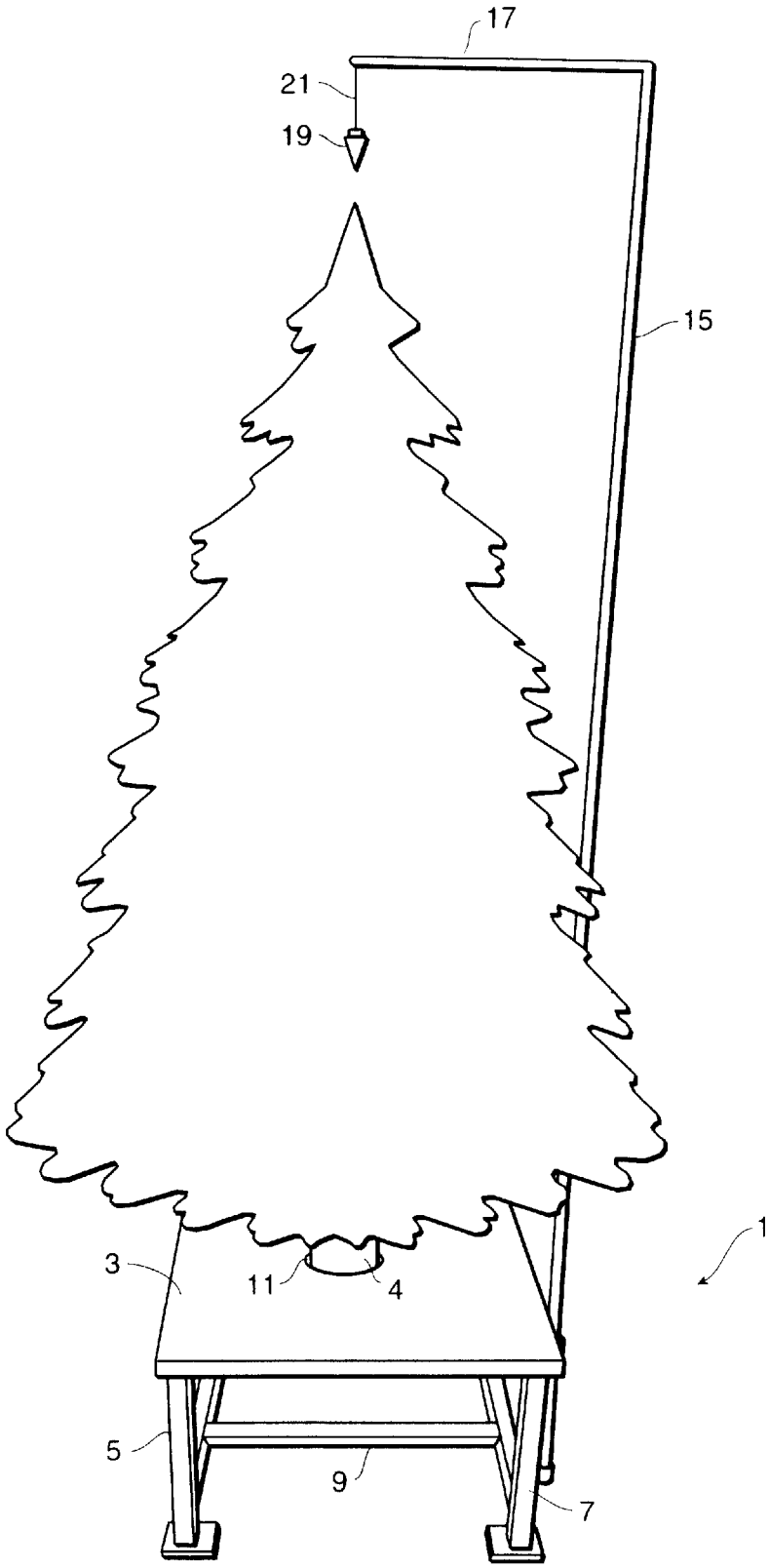
FIG. 1 is a side perspective view of the tree trimming apparatus of the present invention.

While the present invention is susceptible of embodiment in various forms, as shown in the drawings, hereinafter will be described the presently preferred embodiments of the invention with the understanding that the present disclosure is to be considered as an exemplification of the invention, and it is not intended to limit the invention to the specific embodiments illustrated.

Figures 10, 11:
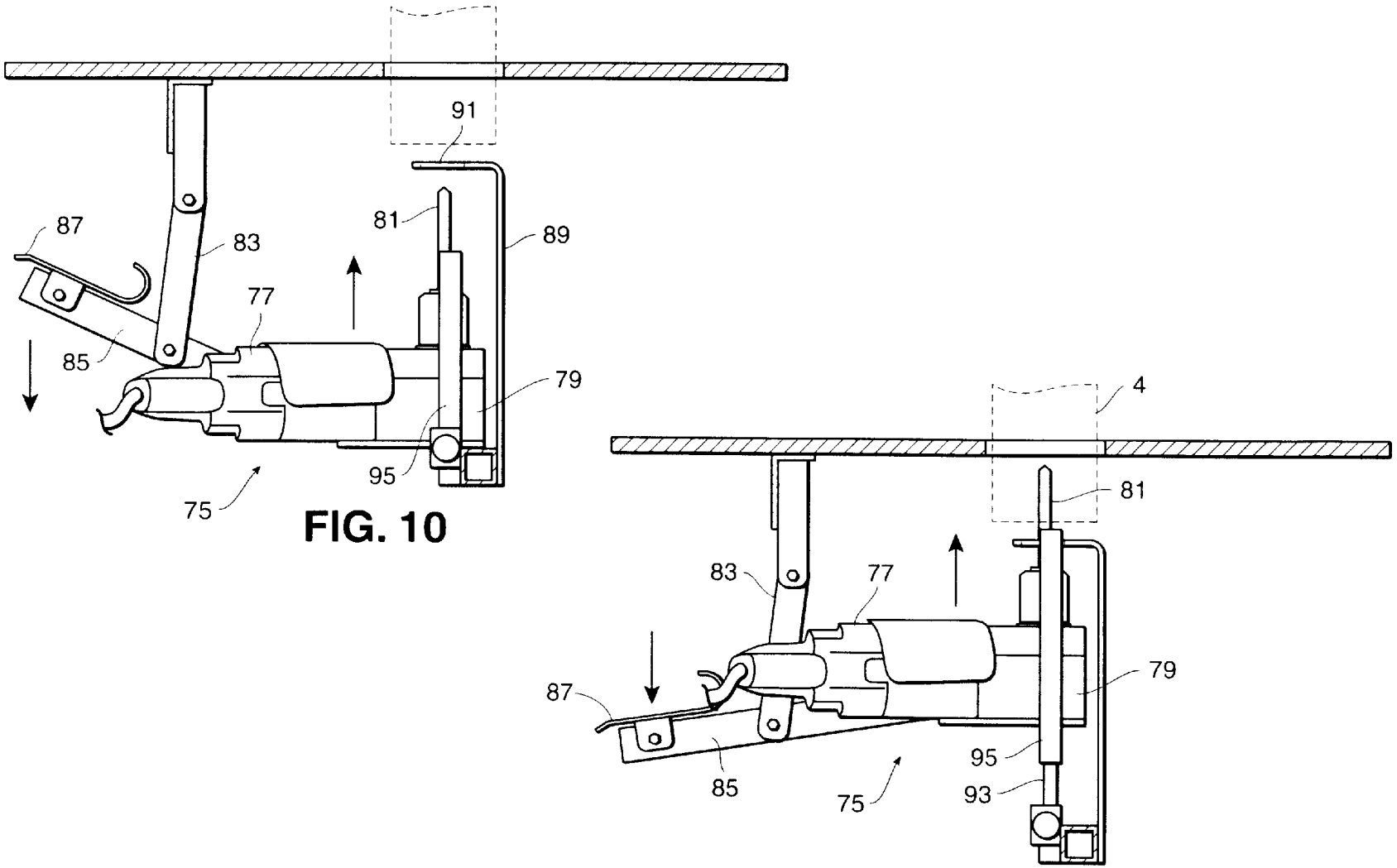
FIG. 10 is a cutaway side view illustrating the position of the drill assembly below the platform and opening prior to boring a recess into a tree trunk.
FIG. 11 is a cutaway side view illustrating the drill assembly shown in FIG. 10 wherein the drill assembly has been forced upwardly so that a drill bit has formed a recess within the bottom of a tree trunk.

The present invention provides for an improved tree trimming apparatus which enables a user to prepare the base of a tree for attachment to a tree stand. With reference to the figures, the tree trimming apparatus 1 includes a raised platform 3 supported by a frame 5. The frame 5 has four sides, a top, a bottom and is substantially cubic in shape. The frame 5 also includes four legs 7 for supporting the platform 3, and several horizontal support beams 9 for providing rigidity to the frame. The raised platform 3 is positioned on top of the frame, and is square, planar and supported substantially horizontal to the ground by the legs 5. The platform 3 further includes a circular opening sized to receive trunks 4 of trees 2 which are to be trimmed by the tree trimming apparatus. As shown in FIGS. 10 and 11, the frame 5 further includes a tree support 89 which limits the distance that the tree trunk 4 projects through the opening 11.

In a preferred embodiment, and as shown in FIG. 1, the tree trimming apparatus 1 may include a vertical pole 15 extending upwardly from the side of the frame 5. The vertical pole 15 projects upwardly above the height of trees trimmed by the present invention and is intended to provide assistance in enabling persons to visually align a tree as close as possible to vertical when having the trunk of the tree trimmed. The vertical pole may include a horizontal cross beam 17 affixed to its upper end. Moreover, the cross beam may include a plumb line 21 and plumb bob 19 which extend downward over the center of the opening 11. Where the tree trimming apparatus is properly positioned on a flat ground, the top of the tree can be aligned with the plumb bob 19, plumb line 21 and pole 15 to obtain a vertically aligned tree.

As best shown in FIGS. 2–7, the tree trimming apparatus 1 includes a jaws assembly 21 for grasping the trunk of a tree 4. The jaws assembly 21 may take various constructions, as can be determined by those skilled in the art. In a preferred embodiment, the jaws assembly 21 includes a plurality of jaws 23 affixed to the bottom of the platform 3. The jaws 23 are moveable radially with respect to the center of the opening 11 to enable the jaws to project inwardly and engage the trunk of a tree which has been projected through the opening 11. The jaws may be biased inwardly by various means known to those skilled in the art, including using threaded rods having crank handles. However, in a preferred embodiment and as shown in the figures, the jaws are biased inwardly by compression springs 25. The jaws are affixed in place upon the bottom of the platform 3 by brackets 31 having cylindrical housings 33. The cylindrical housings 33 encase one end of the compression spring 25 while the other end of the compression spring engages the individual jaws 23 to bias them inward towards the center of the hole 11.

Figure 2:
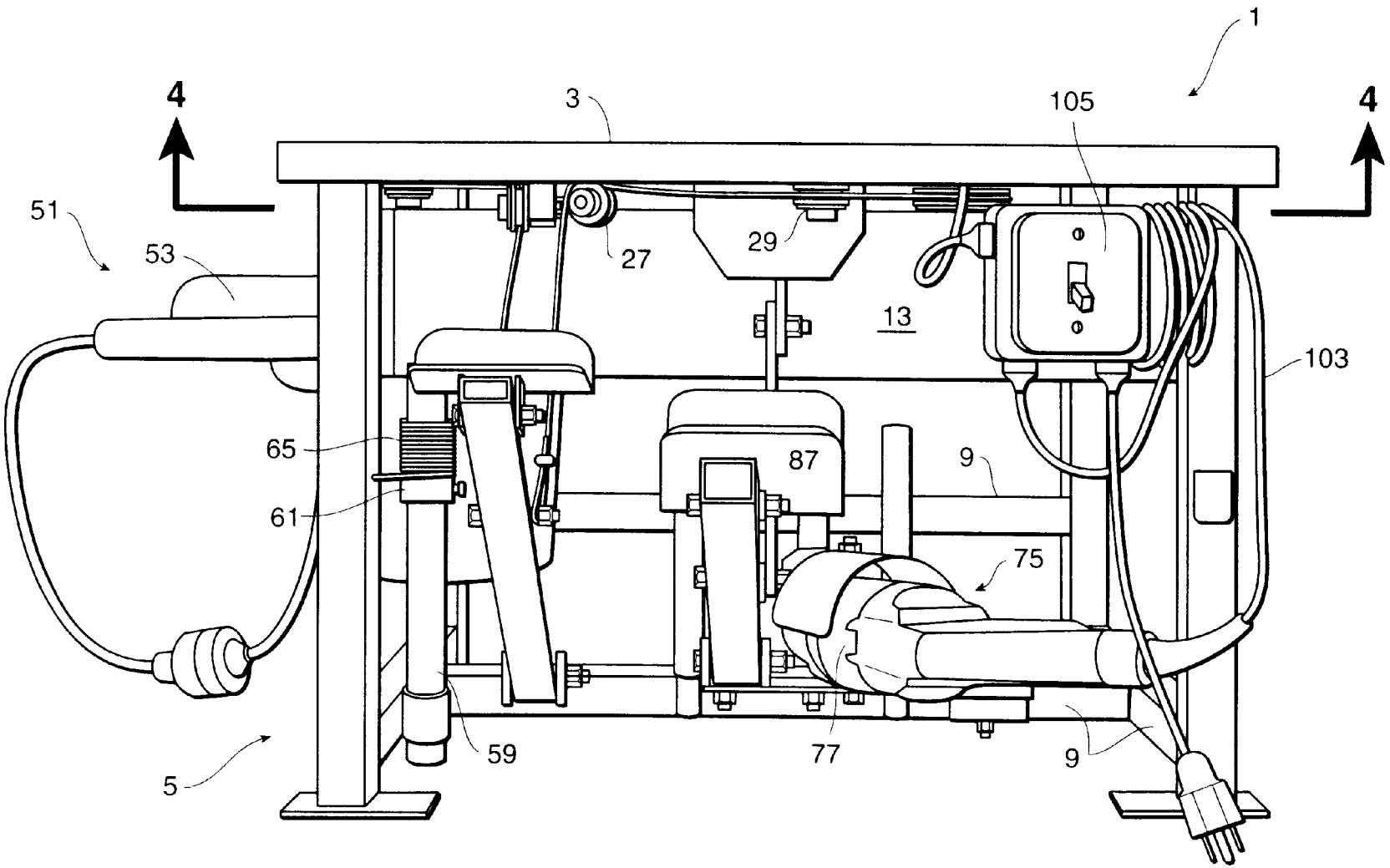
FIG. 2 is a close-up front side view of the tree trimming apparatus of the present invention.
Figure 3:
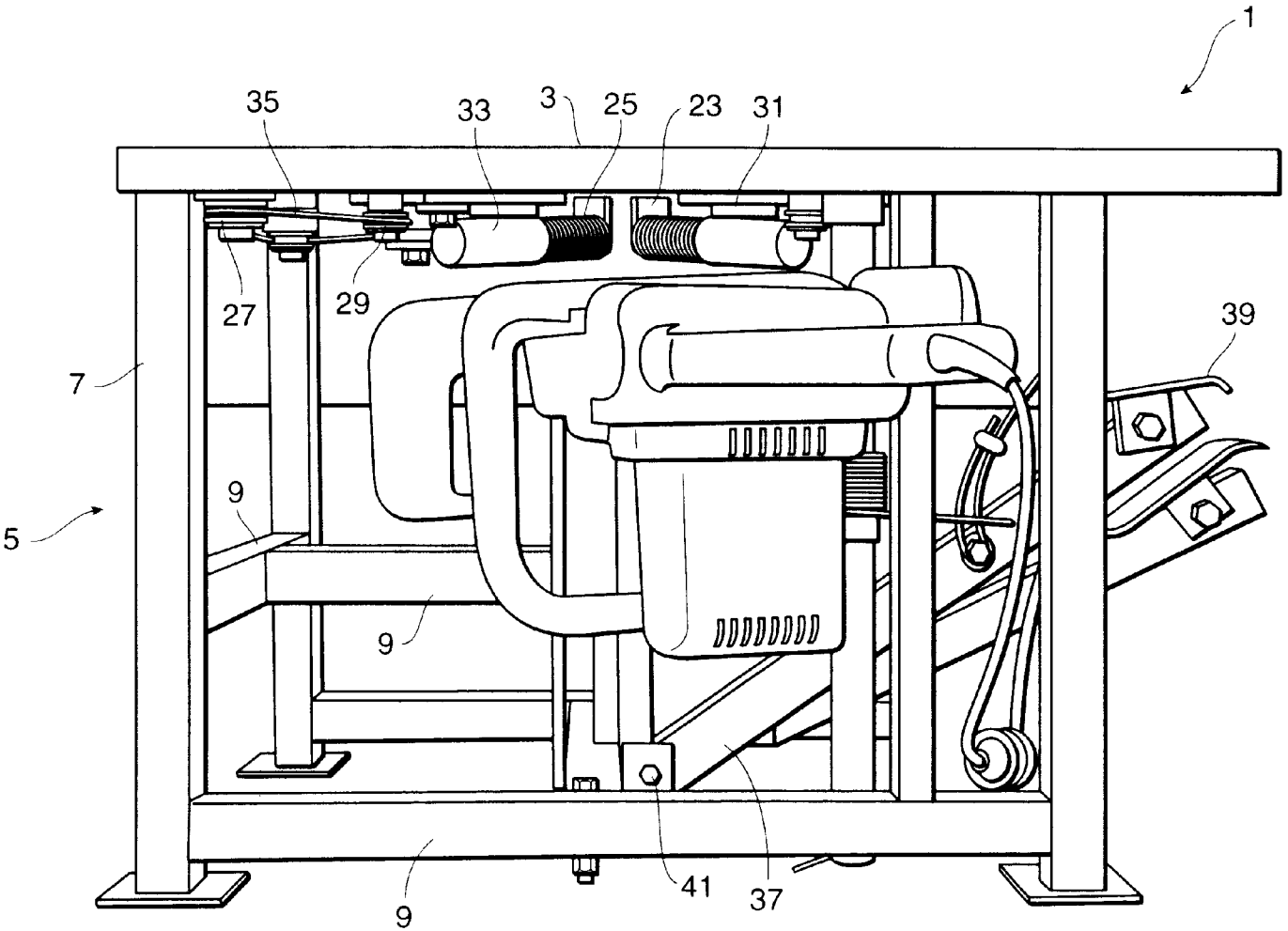
FIG. 3 is a close-up left side view of the tree trimming apparatus of the present invention.
Figure 4:
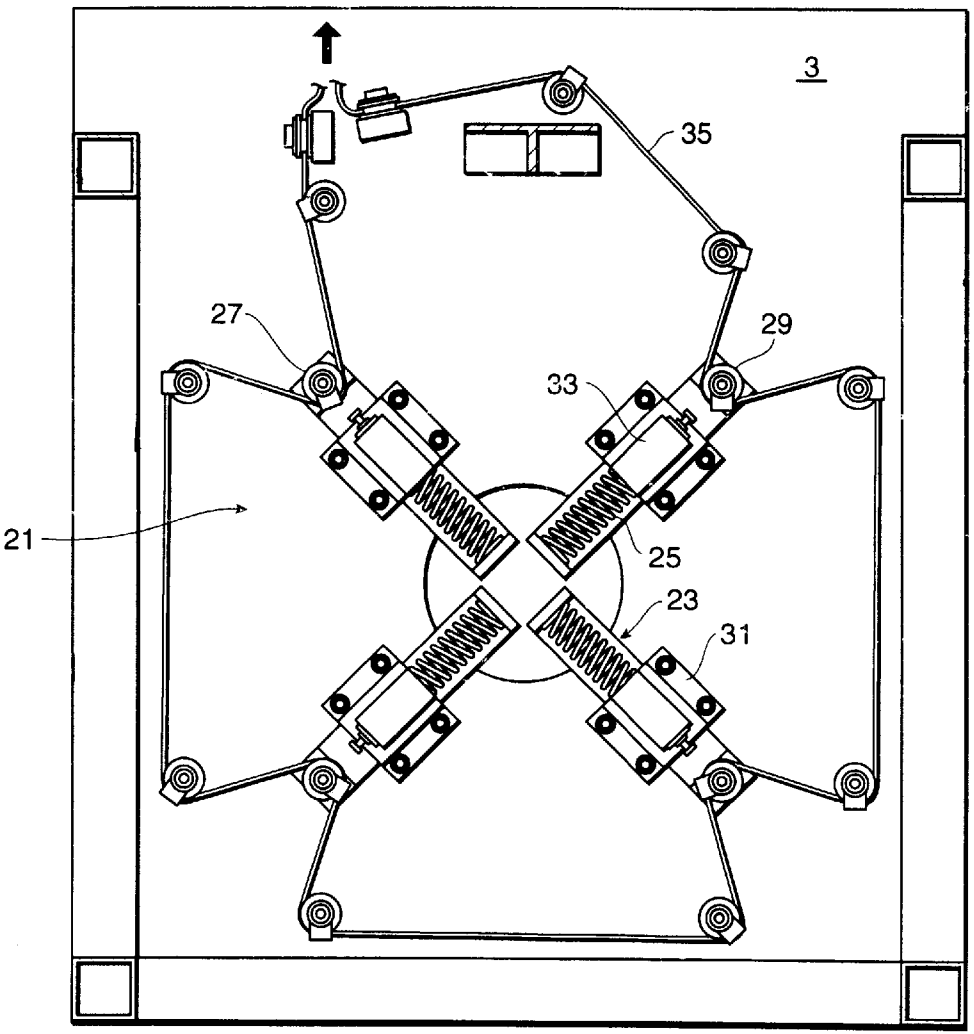
FIG. 4 is a cutaway bottom plan view illustrating the jaw assembly of the tree trimming apparatus of the present invention.
Figure 5:
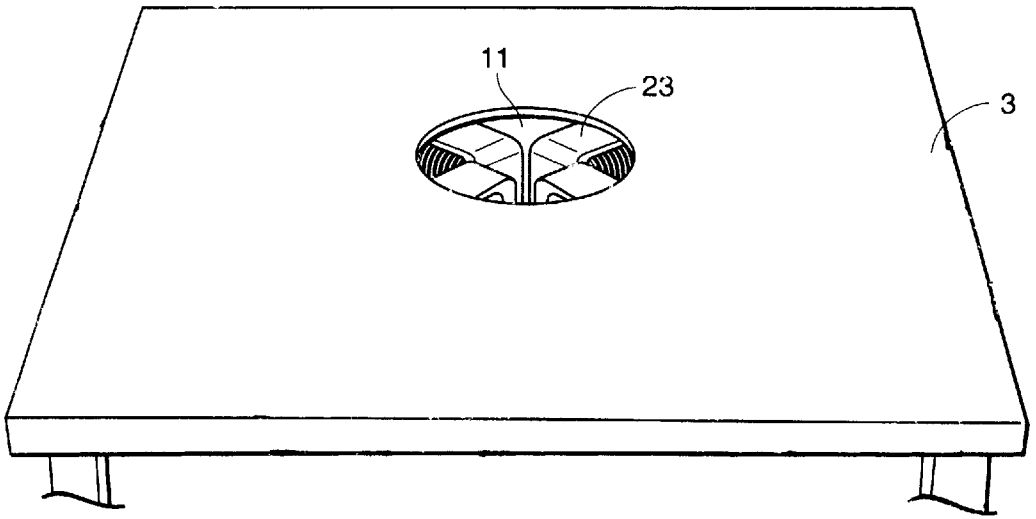
FIG. 5 is a top perspective view illustrating the platform and opening of the tree trimming apparatus of the present invention.
Figure 6:
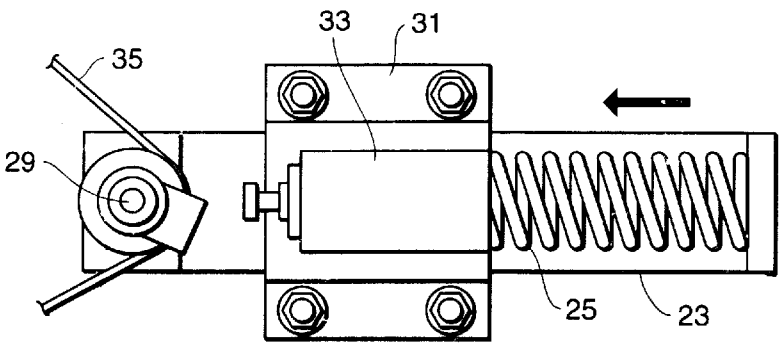
FIG. 6 is a bottom plan view showing an individual jaw in an expanded position for grasping a tree trunk.
Figure 7:
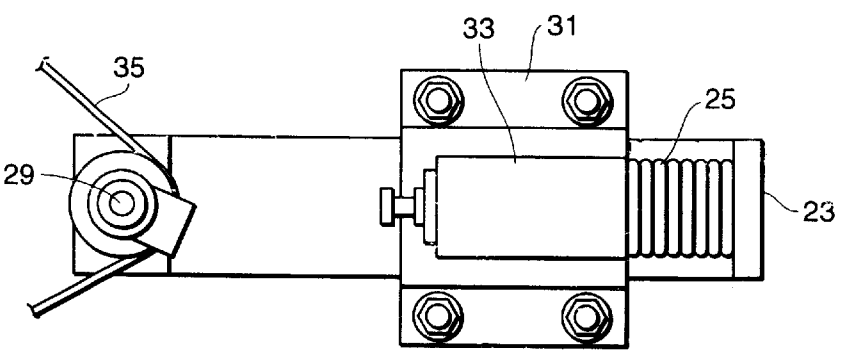
FIG. 7 is a bottom plan view of the individual jaw shown in FIG. 6 in a retracted position.

To retract the individual jaws 23 to allow a tree trunk to project into the opening 11, the tree trimming apparatus includes a pulley system. The pulley system includes a cable 35 wound through a series of pulleys 27 affixed to the platform, and wound through a series of pulleys 29 affixed to the brackets 31 holding the jaws 23. As best shown in FIG. 4, tension placed on the cable causes the cable to retract and force the bracket pulleys 29 outwardly, to in turn force the individual jaws 23 outwardly. Tension can be placed on the chord by various means such as a hand crank. However, to provide the operator of the invention with hands-free capabilities, it is preferred that the tension on the cable be placed by a lever arm and foot pedal construction. As shown in FIGS. 2 and 3, a lever arm 37 is pivotly affixed at one end to a bottom support beam 9. At the opposite end of the support arm is affixed a pedal, while opposing ends of the cable 35 are affixed to the arm 37 intermediate to the pedal and pivot point. Depression of the pedal causes the cable to retract and the jaws to project outwardly. Conversely, due to the force of the compression springs, removal of weight from the pedal 39 causes the jaws to project inwardly to grasp the trunk of a tree.

Figure 9:
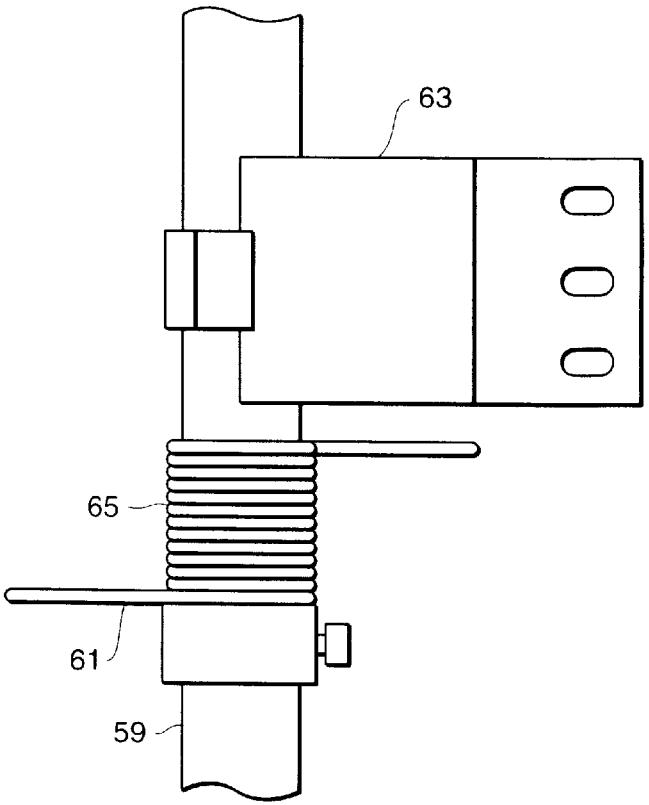
FIG. 9 is a side view illustrating the vertical column, coil spring and bracketry for positioning and affixing a motorized saw for use with the tree trimming apparatus of the present invention.
Figure 8:
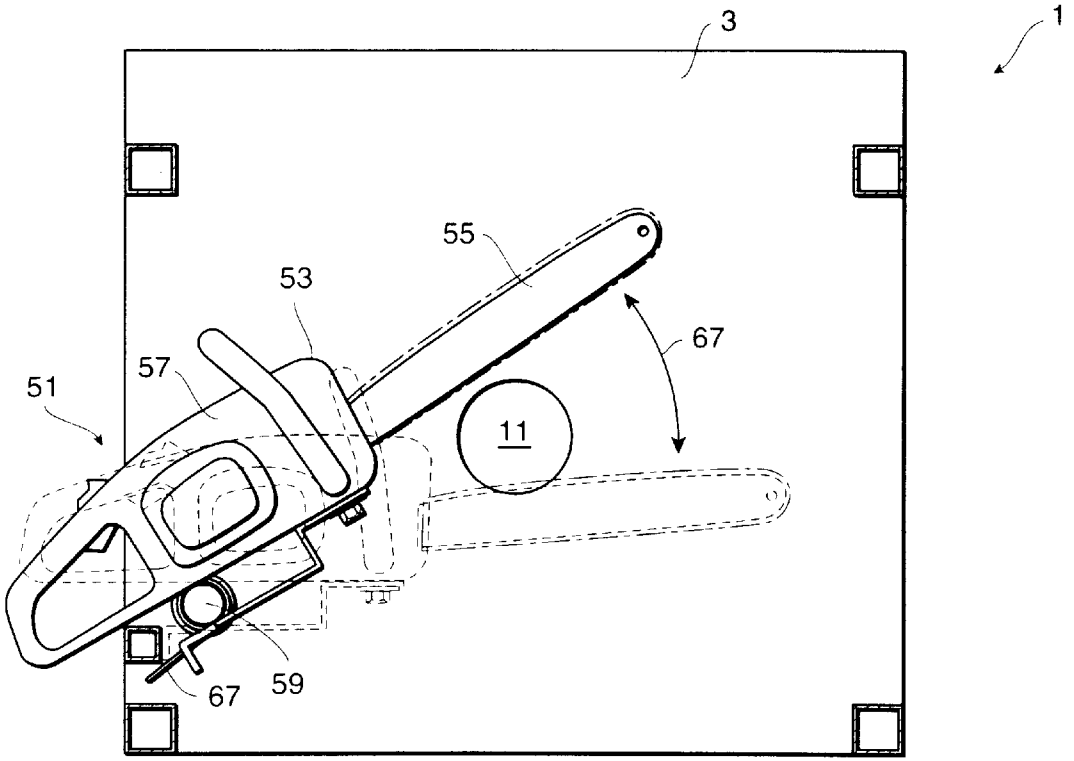
FIG. 8 is a cutaway bottom plan view illustrating the rotation of the saw assembly below the platform and opening of the tree trimming apparatus of the present invention.

With reference to FIGS. 3, 8 and 9, the tree trimming apparatus 1 of the present invention also includes a saw assembly 51. The saw assembly 51 includes a motorized saw 53, such as a chainsaw or circular saw, for driving a blade 55. As shown in FIG. 8, a motorized saw 53, in the form of a chainsaw, is positioned underneath the platform 3 and rotatably affixed to a vertical column 59. As shown in the figures, the motorized saw is positioned so that the blade 55 sweeps a path 69 in the horizontal plane directly below the opening 11. The motorized saw is affixed to the vertical column 59 by a bracket 63, and the motorized saw is biased to a first position by a coil spring 65. Preferably, the motorized saw 53 and blade 55 are vertically adjustable relative to the platform 3. To this end, as shown in FIG. 9, the motorized saw and bracket 63 are vertically positioned by a collar 61. The collar 61 may be moved upwardly and downwardly upon the vertical column 59 by the use of a set screw or the like, which in turn adjusts the vertical position of the motorized saw 53. Also preferably, the saw assembly includes stops 67 which limit the path 69 of the saw blade to underneath the platform 3. The stops then prevent the saw blade from rotating from under the platform which could create a safety concern.

With reference to FIGS. 10–13, the tree trimming apparatus 1 of the present invention preferably includes a drill assembly 75. The drill assembly 75 is mounted within the frame 5 adjacent to a tree support 89. The drill motor may be gas powered, though in a preferred embodiment the drill is electric powered with electricity supplied through a chord 103. Also preferable, the drill assembly 75 includes a 90° gear assembly connecting the drill bit 81 to the drill motor 77. The 90° gear assembly conserves space underneath the platform 3 by allowing the gear motor to extend in a plane perpendicular to the axis of the drill bit.

To bore a recess into the bottom of a tree trunk, the drill assembly 75 including drill bit 81 can be moved upwardly and downwardly. To this end, the drill motor is attached by a bracket to a lever arm 85 which rotates about a pivot point provided by a fulcrum beam 83. The arm 85 further includes a pedal 87 positioned so that depression of the pedal causes the arm to rotate and drill motor and drill bit to move upwardly. As the drill bit moves upwardly, it projects through a hole 91 formed in the tree support 89 to engage the bottom of the tree trunk 4. To maintain vertical alignment of the drill bit during upward and downward movement, the drill assembly 75 includes a vertical rod 93 which telescopically receives an alignment cylinder 95 affixed to the drill motor. As the drill motor is moved upwardly by the pedal 87 and arm 85, the alignment cylinder 95 and guide rod 93 cause the drill motor 87 and drill bit 81 to rotate relative to the arm 85 so that the drill bit is maintained in a vertical orientation throughout upward and downward movement.

Figure 12:
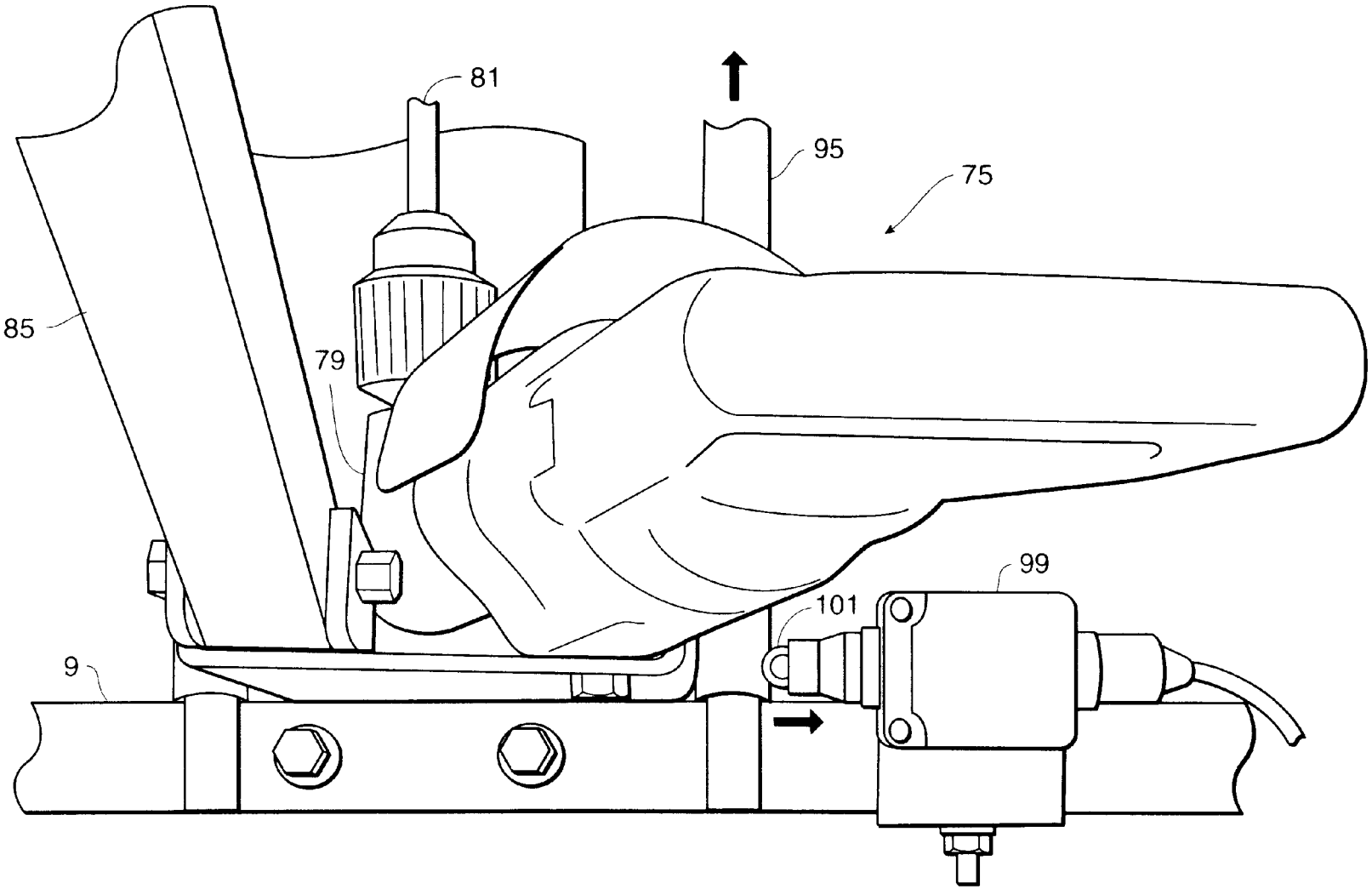
FIG. 12 is a close-up side view of the drill assembly including a lock for locking the drill assembly into a downward position.
Figure 13:
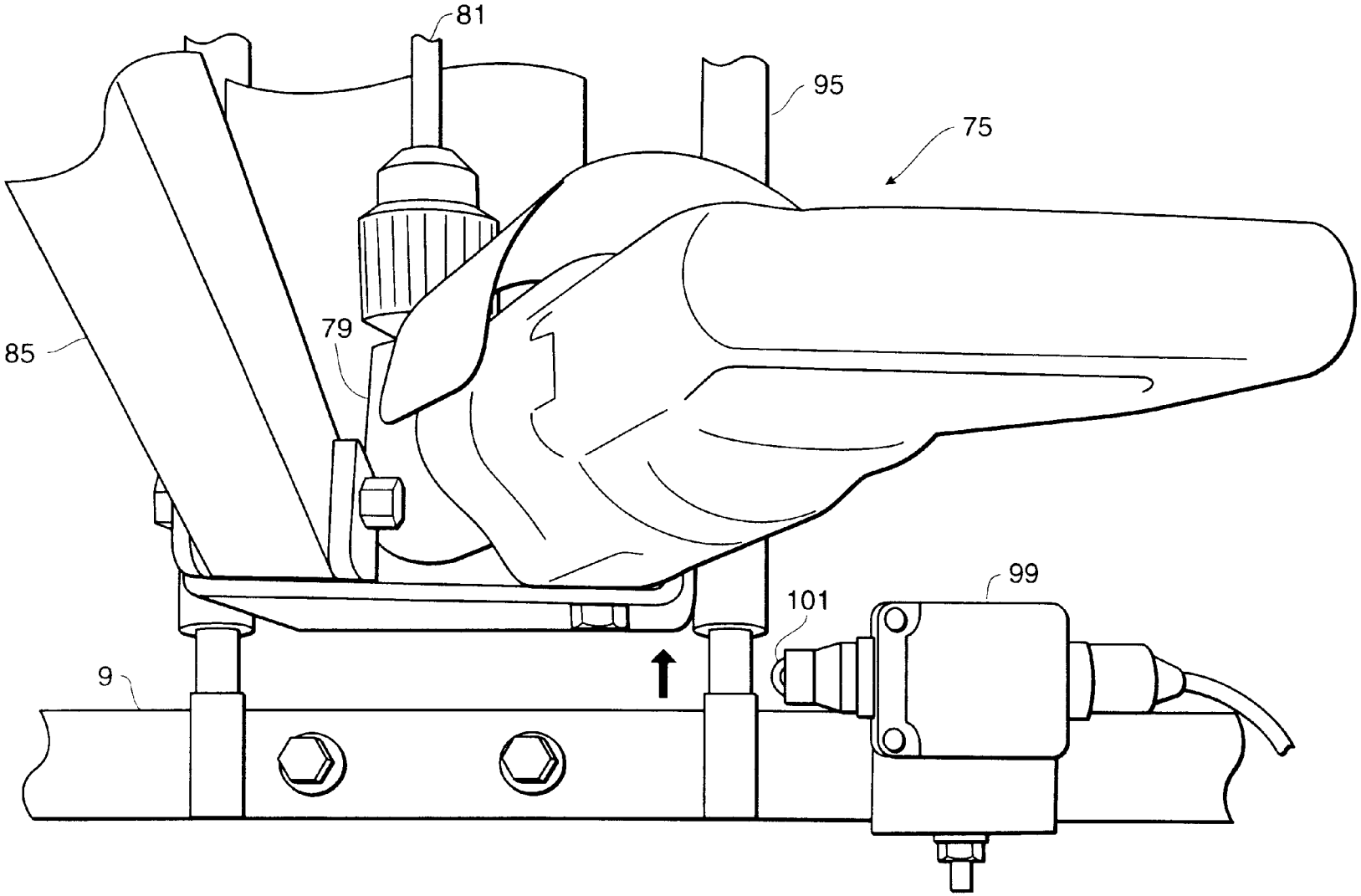
FIG. 13 is a side view showing the drill assembly illustrated in FIG. 12 wherein the lock has been disengaged.

With reference to FIGS. 12 and 13, a preferred embodiment the tree trimming apparatus 1 includes a locking mechanism for locking the drill motor and drill bit in a downward position when the apparatus is not being used. As shown in FIGS. 12 and 13, the safety mechanism includes a solenoid 99 having an engagement brake 101. Absence of power to the solenoid 99 causes the engagement break 101 to project outwardly to engage the alignment cylinder 95. The solenoid 99 is affixed in place so that the alignment cylinder 95, drill motor 77 and drill bit 81 are restrained from vertical movement. Meanwhile, as shown in FIG. 13, power to the solenoid 99 causes the engagement break 101 to retract and disengage from the alignment cylinder 95, thereby permitting vertical movement of the drill motor and drill bit. Activation of the solenoid, and thus disengagement of the engagement break 101 may be accomplished by providing power to the solenoid, such as by simply throwing a switch or by connecting the solenoid chord to a power source.

The above-described tree trimming apparatus provides an ideal structure for preparing a tree for attachment to a tree stand. In operation, and as shown in the figures, the tree trimming apparatus 1 is placed on level ground. The individual jaws 23 are retracted by depression of foot pedal 39. A tree is then positioned over the platform 3 and the tree's trunk is projected through the platform's opening 11. As shown in FIGS. 10 and 11, the bottom of the tree's trunk projects through the opening 11 until it rests upon the top of the tree support 89. With reference to FIG. 4, the jaws are caused to be forced inwardly by releasing pressure upon the pedal 39 until the jaws engage the side of the tree's trunk 4 and the tree is affixed in place.

To cut off a portion of the tree's trunk, the vertical position of the motorized saw 53 is adjusted by moving the collet 61. The motorized saw is then manually rotated so that the blade 55 strikes the side of the tree's trunk and follows a horizontal path until a portion of the tree's trunk has been completely severed.

If the tree is to be attached to a tree stand having a single central vertical spike, the drill bit is forced upwardly by depressing its corresponding pedal 87 until the rotating drill bit 81 has projected through the hole 91 in the tree support 89 and has formed a recess in the bottom of the tree's trunk.

Once the bottom of the tree's trunk has been properly machined, the individual jaws holding the tree are retracted by depressing pedal 39 until the jaws have disengaged from the side of the tree's trunk. Thereafter, the tree is manually lifted from the platform's opening 11 and the tree is attached to a tree stand.

Although particular preferred embodiments of the present invention have been described herein, it is to be understood that variations may be made in the construction, materials and shape of the tree trimming apparatus without departing from the spirit or scope of the invention.

Having described my invention in such terms to enable those skilled in the art to make and use it, and having identified the presently preferred embodiments thereof, I claim:

1. A tree trimming apparatus comprising:

a raised platform having a plurality of legs for resting the tree trimming apparatus upon the ground, said platform including an opening sized and configured for receiving the trunk of a tree; and one or more tools positioned underneath said raised platform for engaging the trunk of a tree received through said opening.

2. The tree trimming apparatus of claim 1 wherein said one or more tools includes a saw having a blade positioned underneath said raised platform; said saw rotatably affixed about the axis perpendicular to said platform so that said blade sweeps a path underneath said opening for trimming the trunk of a tree received through said opening.

3. The tree trimming apparatus of claim 2 further comprising a plurality of jaws positioned underneath said raised platform, said jaws movably mounted underneath said raised platform so as to retract and project toward the center of said opening so as to grip the trunk of a tree that has been received through said opening.

4. The tree trimming apparatus of claim 1 wherein said one or more tools includes a drilling apparatus having a drill bit positioned underneath said opening, said drilling apparatus movably mounted underneath said raised platform so that said drill bit is aligned in the axis perpendicular to said platform and can be controllably projected upward underneath the center of said opening for boring a depression into the trunk of a tree received through said opening.

5. The tree trimming apparatus of claim 4 further comprising a plurality of jaws positioned underneath said raised platform, said jaws movably mounted underneath said raised platform so as to retract and project toward the center of said opening so as to grip the trunk of a tree that has been received through said opening.

6. A tree trimming apparatus comprising:

a raised platform having a plurality of legs for resting the tree trimming apparatus upon the ground, said platform including an opening sized and configured for receiving the trunk of a tree; and a saw having a blade positioned underneath said raised platform; said saw rotatably affixed about the axis perpendicular to said platform so that said blade sweeps a path underneath said opening for trimming the trunk of a tree received through said opening.

7. The tree trimming apparatus of claim 6 further comprising a plurality of jaws positioned underneath said raised platform, said jaws movably mounted underneath said raised platform so as to retract and project toward the center of said opening so as to grip the trunk of a tree that has been received through said opening.

8. The tree trimming apparatus of claim 6 further comprising a drilling apparatus having a drill bit positioned underneath said opening, said drilling apparatus movably mounted underneath said raised platform so that said drill bit is aligned in the axis perpendicular to said platform and can be controllably projected upward underneath the center of said opening for boring a depression into the trunk of a tree received through said opening.

9. The tree trimming apparatus of claim 6 further comprising stops for maintaining the path of said blade under said platform.

10. A tree trimming apparatus comprising:

a raised platform having a plurality of legs for resting the tree trimming apparatus upon the ground, said platform including an opening sized and configured for receiving the trunk of a tree; and a drilling apparatus having a drill bit positioned underneath said opening, said drilling apparatus movably mounted underneath said raised platform so that said drill bit is aligned in the axis perpendicular to said platform and can be controllably projected upward underneath the center of said opening for boring a depression into the trunk of a tree received through said opening.

11. The tree trimming apparatus of claim 10 further comprising a saw having a blade positioned underneath said raised platform; said saw rotatably affixed about the axis perpendicular to said platform so that said blade sweeps a path underneath said opening for trimming the trunk of a tree received through said opening.

12. The tree trimming apparatus of claim 10 further comprising a locking means for locking movement of said drilling apparatus.

13. The tree trimming apparatus of claim 12 said locking means locks movement of said drilling apparatus unless electrical power is provided to said drill apparatus.

* * * * *